United States Patent [19]

Cohen

[11] Patent Number: 4,699,439

[45] Date of Patent: Oct. 13, 1987

[54] TRACK LIGHTING ADAPTER

[75] Inventor: Joel S. Cohen, Oakland, Calif.

[73] Assignee: Prescolite, Inc., San Leandro, Calif.

[21] Appl. No.: 850,154

[22] Filed: Apr. 10, 1986

[51] Int. Cl.[4] ..... H01R 13/60; H01R 13/422

[52] U.S. Cl. ..... 439/207; 439/586; 439/119

[58] Field of Search ..... 339/59 M, 210 M, 59 R, 339/20, 21 R, 21 S, 22 R, 22 B, 22 T, 23, 24, 210 R

[56] References Cited

U.S. PATENT DOCUMENTS

| | | | |
|---|---|---|---|
| 3,496,518 | 12/1970 | Neumann et al. | 339/21 R |
| 3,519,978 | 7/1970 | Taormina et al. | 339/59 M |
| 3,693,134 | 9/1972 | Trevisiol | 339/59 M |
| 3,832,503 | 8/1974 | Crane | 200/51 R |
| 4,443,047 | 4/1984 | Hofmann | 339/208 |

*Primary Examiner*—Gil Weidenfeld
*Assistant Examiner*—Gary F. Paumen
*Attorney, Agent, or Firm*—Bielen & Peterson

[57] ABSTRACT

An adapter for electrically and mechanically attaching a lighting fixture to a lighting track which utilizes a body having first and second end portions. The first end portion of the body connects to the lighting track while the second end portion of the body holds the lighting fixture. The body includes a pair of conductors which are each held in a chamber formed by a recess in the body and a door connected to the body. One of the conductors is movable such that it extends further from the body than the other conductor which is compatible with a two circuit lighting track.

3 Claims, 8 Drawing Figures

FIG-8
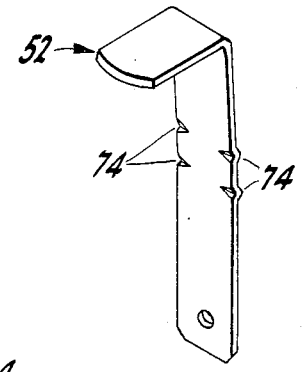
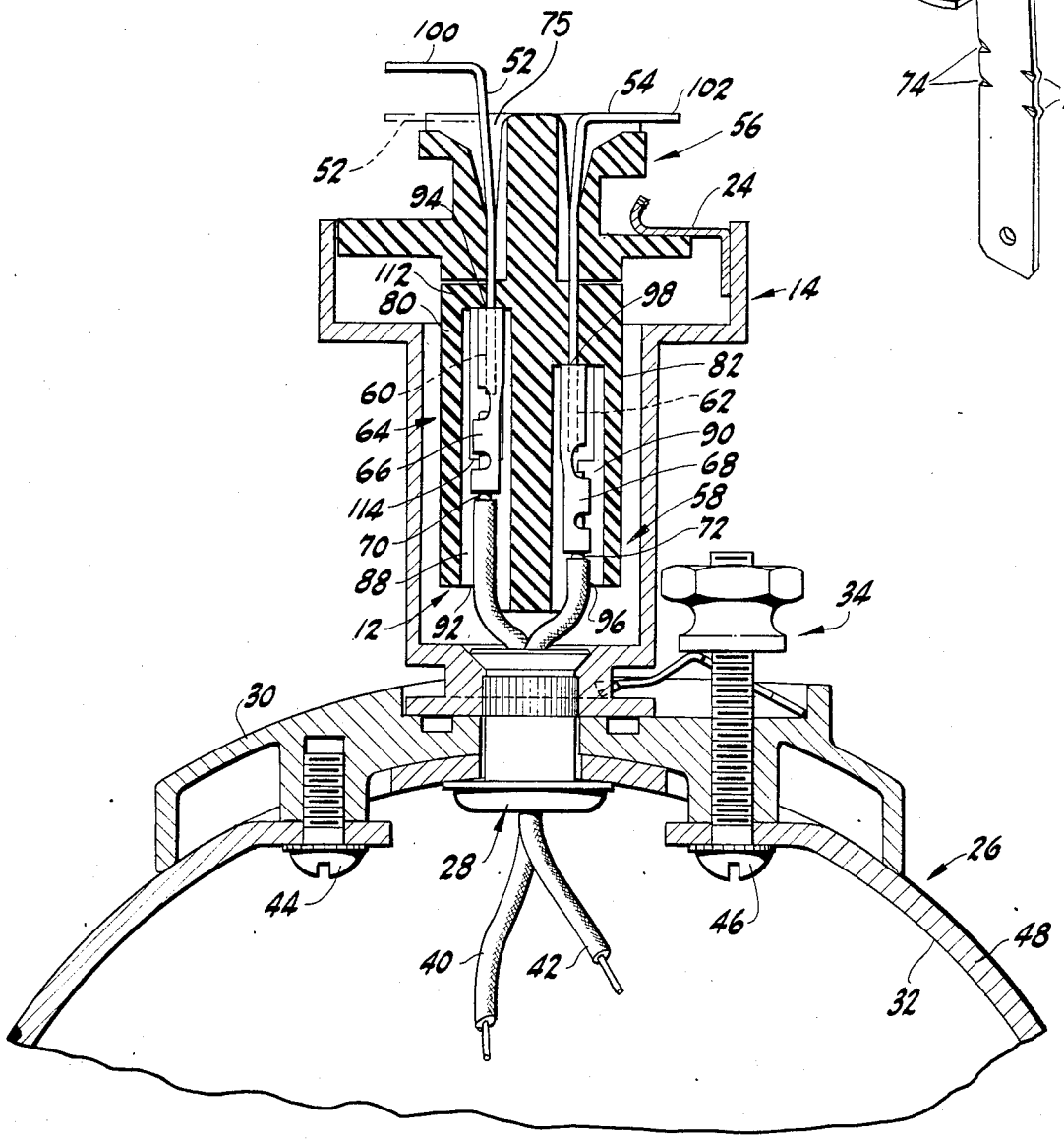
FIG-3

FIG-4
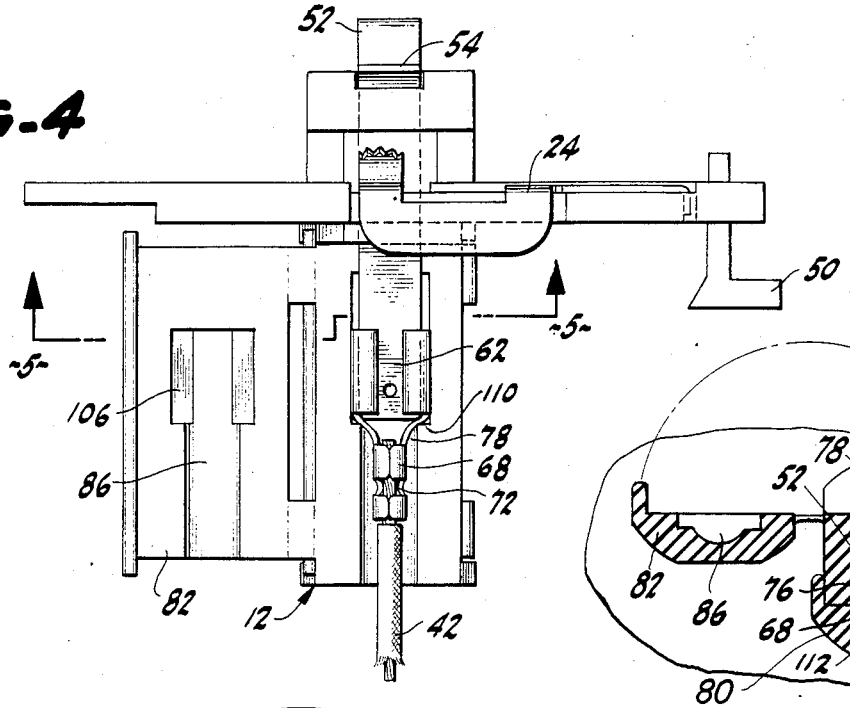
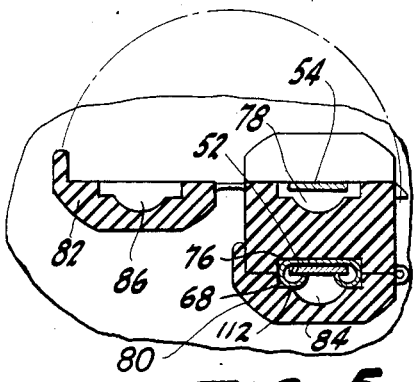
FIG-5
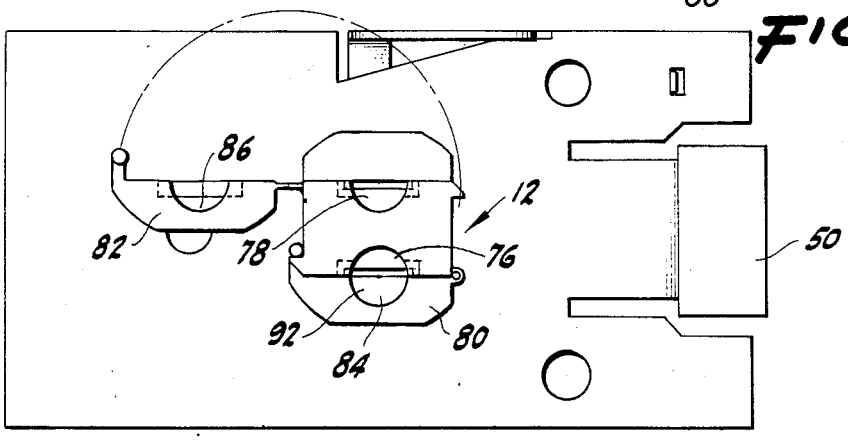
FIG-6
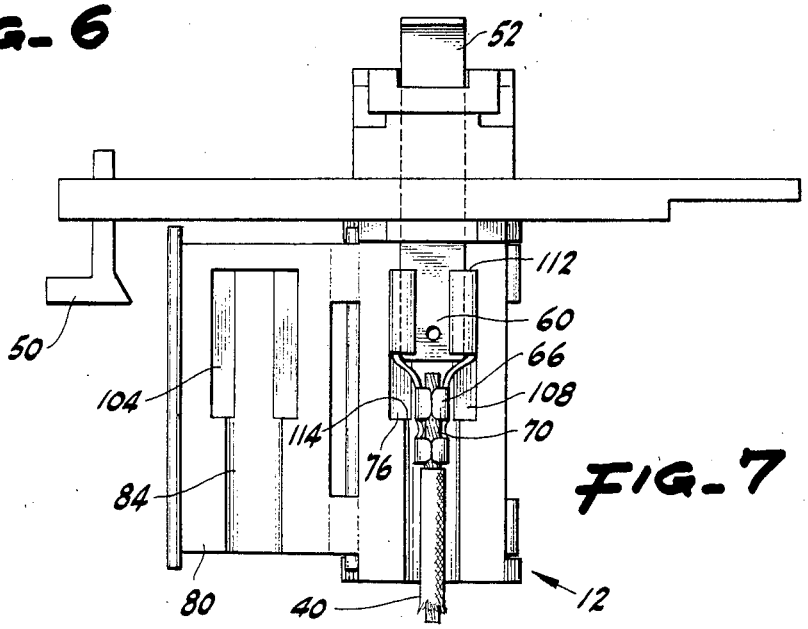
FIG-7

TRACK LIGHTING ADAPTER

BACKGROUND OF THE INVENTION

The present invention relates to the field of track lighting. A novel adapter for a track lighting system is herein provided.

Track lighting has been established as a system of lighting the interior of a room or other enclosure. In certain circumstances it is desirable to provide two circuits on the lighting track in order to separately control two sets of lighting fixtures.

Reference is made to U.S. Pat. Nos. 3,496,518 and 3,832,503 which provide for adapters which accommodate lighting tracks with dual circuits. The adapters described in the above patents are quite complex and entail intricate assembly methods. In addition, the prior art track lighting adapters hereinabove referenced are very difficult to repair since the conductors are inaccessible after assembly of the track lighting adapter.

An adapter for electrically and mechanically attaching a lighting fixture to a lighting track which is simple to assemble and easy to maintain would be an advance in the art of lighting.

SUMMARY OF THE INVENTION

In accordance with the present invention a novel and useful adapter for electrically and mechanically holding a lighting fixture to a lighting track is hereinprovided.

The adapter of the present invention utilizes a body which includes a first and second end portions. The first end portion of the body is employed of means for mechanically connecting the same to the lighting track. The second end portion of the body is mechanically linked to the lighting fixture.

A adapter also is constructed with the first conductor positioned within the body. The body includes a first recess for at least partially enclosing the first conductor. A first door which may be hingedly connected to the body forms a first chamber with the first recess with the body. The first door may also include a recess to form such a chamber. Likewise the body possesses a second conductor which is positioned within a chamber formed by a recess in the body and a recess in a door which may be hingedly attached to the body. Both first and second chambers include first and second openings for permitting extension portions of the first and second conductors into and out of the first and second chambers.

The first chamber is sufficiently large to permit movement of the first conductor within the same. The first conductor may extend further away from the exterior of the body than the second conductor. The first chamber may be formed with a stop for limiting such extension of the first conductor from the body. Thus, the first conductor may extend fromt hebody at two distinct positions corresponding to the two tracks in a two circuit lighting track. The second chamber would inhibit movement of the second conductor such that its single position corresponds to the level of the first conductor in its extension from the body.

The present invention may also include means for electrically connecting the first and second conductors to the lighting fixture. In the case of the first conductor, the connecting means includes mating of first and second portions of the first conductor within the first chamber. The second conductor may also possess such means for connection between first and second portions within the second chamber.

It may be apparent that a novel and useful adapter for electrically and mechanically connecting a lighting fixture to a lighting track has been described.

It is therefore an object of the present invention to provide a track lighting adapter which may be easily and cheaply assembled.

Is another object of the present invention to provide a track lighting adapter which is accessible after assembly for maintenance and repair of the same.

Another object of the present invention is to provide a track lighting adapter which is simple to manufacture and is electrically safe in its assembled condition.

The invention possesses other objects and advantages especially as concerns particular characteristics and features thereof which will become apparent as the specification continues.

BRIEF DESCRIPTION OF THE DRAWINGS

FIG. 3 is a sectional view taken along 3—3 of FIG. 1.

FIG. 4 is a side elevational view of the adapter portion of the device of the present invention.

FIG. 5 is a sectional view taken along line 5—5 of FIG. 4.

FIG. 6 is a bottom plan view of the adapter of the device of the present invention shown in FIG. 4.

FIG. 7 is a rear elevational view of the adapter of the device of the present invention shown in FIG. 4.

FIG. 8 is a upright perspective view of a conductor prong used in the adapter of the device of the present invention.

For a better understanding of the invention reference is made to the following detailed description of the preferred embodiments of the present invention which should be referenced to the hereinabove drawings.

DETAILED DESCRIPTION OF THE PREFERRED EMBODIMENTS

Various aspects of the invention will evolve from the following detailed description of the preferred embodiments which should be taken in conjunction with the hereinabove drawings.

Figure 2:
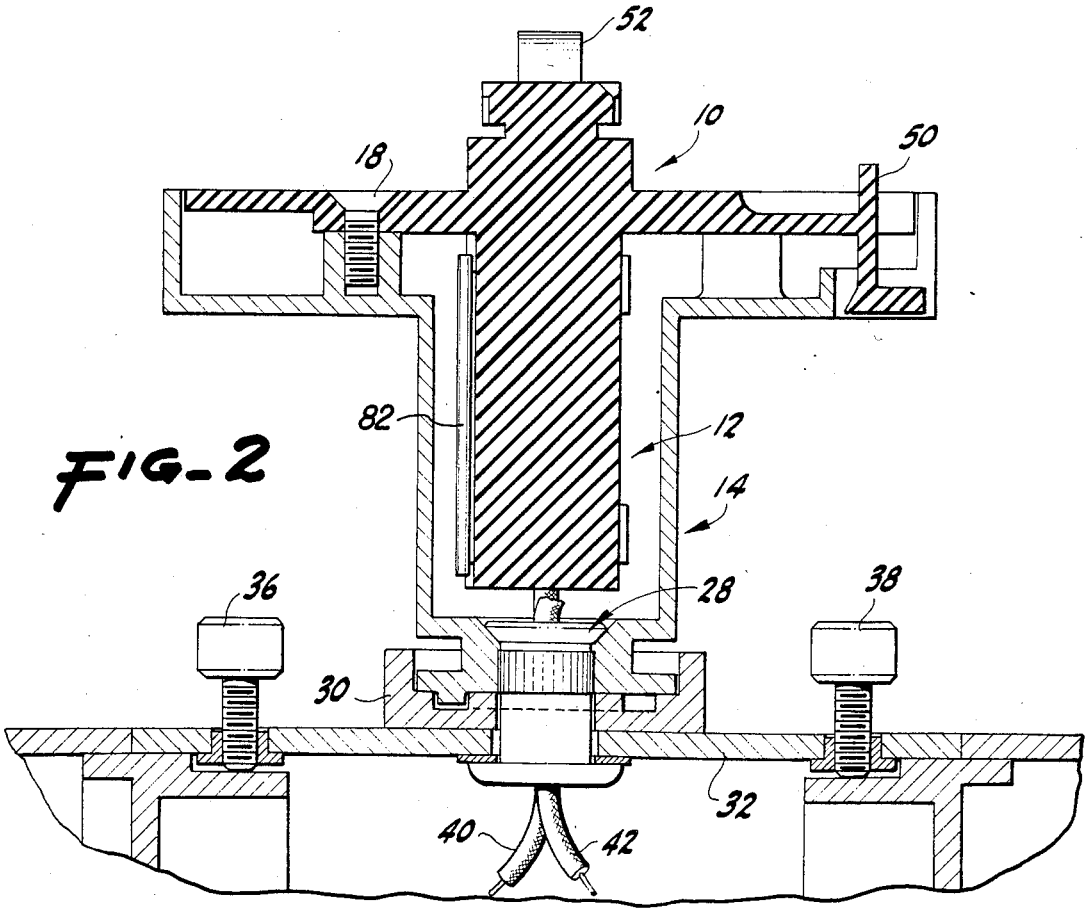
FIG. 2 is a sectional view taken along 2—2 of FIG. 1.

The device of the present invention is shown in the drawings as a whole by reference character 10. The track adapter 10 includes as one of its elements a body 12 which may be formed of plastic or other similar material. Body 12 is attached to housing 14 by fastening means 16 which includes set screws 18 and 20. Housing 14 may be constructed of metal, plastic, or other suitable material. Set screw 22 holds grounding blade 24 in place. Housing 14 connects to a track lighting fixture 26 with a flare bushing 28 which passes through fixture arm 30 and engages the interior surface 32 of lighting fixture 26. Adjustment screws 34, 36, 38, FIGS. 2 and 3, serve to control the movement of portions of fixture 26 and are shown here for the sake of completeness. Electrical leads 40 and 42 connect to the lamp in lighting fixture 26 as well as any other electrical components therein such as transformers, ballasts, and the like (not shown). Set screws 44 and set screw 46, (a portion of adjustment screw 34) hold fixture arm 32 to body 48 of lighting fixture 26.

Figure 1:
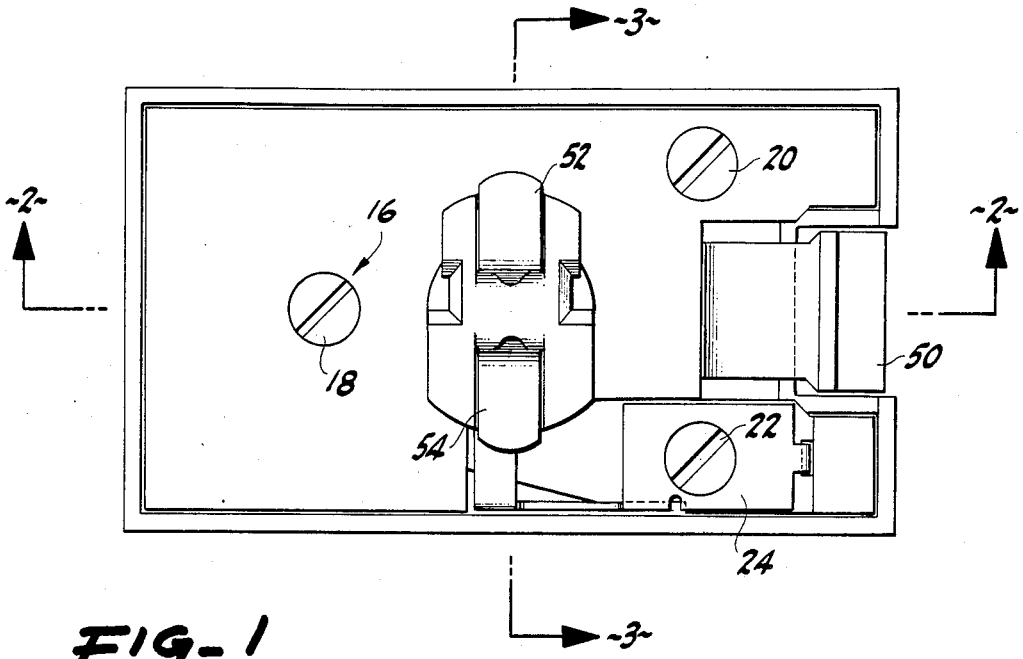
FIG. 1 is a top plan view of the device of the present invention.

Tab 50 on body 12 is formed of naturally springy material and serves to lok body 12 and housing 14 in place on a lighting track (not shown). FIG. 1 further reveals first and second conductor prongs 52 and 54 which contact the "hot" and "neutral" portions of the lighting track. With reference to FIG. 3 it may be noted that first conductor prong 52 is movable from the first position at the same level as conductor prong 54 to a more extended position further from body 12 than prong 54. The two positions illustrated in FIG. 3 for prong 52 (one position shown in phantom) represent the levels where prong 52 would electrically contact either of the two conductors in the lighting track representing two separate circuits. Conductor prong 54 does not move with respect to body 12 in this regard.

With reference to FIG. 3 it may be seen that body 12 includes a first end portion 56 which mechanically connects to the lighting track. Second end portion 58 of body 12 is surrounded and affixed to housing 14 which connects to lighting fixture 26, as heretofore described. Connectors 52 and 54 include first end portions 60 and 62 which are fastened to leads 40 and 42 respectively by means 64, which electrically connects first and second conductors 52 and 54 to the lamp within lighting fixture 26. Second end portions 66 and 68 of first and second conductors 52 and 54 may take the form of terminals which are crimped onto the bare wire ends 70 and 72 of conductors 40 and 42 and onto the second end portions 60 and 62 of conductors 52 and 54. FIG. 8 depicts conductor 52 apart from body 12. Structure of conductor 52 is identical to the structure 54.

Body 12 possesses recesses 76 and 78, FIGS. 4–7. Recesses 76 and 78 at least partially enclose the first end portions 60 and 62 and second end portions 66 and 68 of conductors 52 and 54, respectively. In addition, body 12 is constructed with doors 80 and 82 which are hingedly attached thereto. Doors 80 and 82 also include recesses 84 and 86 respectively. Recesses 76 and 84 form a chamber 88, when door 80 is closed which accommodates the lower first and second end portions 60 and 66 of conductor 52. Likewise, a chamber 90 is similarly formed by recesses 78 and 86 when door 82 is closed, FIG. 3. Chamber 90 similarly encloses conductor 54. Openings 92 and 94 of chamber 88 and openings 96 and 98 of chamber 90 permit the entrance of leads 40 and 42 to the chambers and the egress of conductors 52 and 54 from the chambers.

Chamber 88 is sufficiently large to permit movement of first conductor 52 therewithin and, consequently, to permit horizontal end 100 thereof to extend further from first end 56 of body 12 than the horizontal end 102 of conductor 54. With reference to FIGS. 4 and 6, it may be observed that recesses 84 and 86 in doors 80 and 82 have enlarged portions 104 and 106. Enlarged portions 108 and 110 of recesses 76 and 78 in body 12 correspond to the enlargements 104 and 106 of doors 80 and 82. However, the portion of chamber 88 formed by recesses 104 and 108 is larger than portion of chamber 90 formed by recesses 106 and 110. Thus, terminal 66 holding the first and second end portions of 60 and 66 of conductor prong 52 is movable within the portion of chamber 88 formed by recesses 104 and 108. On the other hand terminal 68 is relatively fixed within the portion of chamber 90 formed by recesses 106 and 110. The end 112 of chamber 88 serves as a stop for the movement of conductor 52 outwardly from end portion 56 of body 12. Also, the lower part 114 of the enlarged portion of chamber 88 formed by recesses 104 and 108 would serve as a stop for the movement of horizontal portion 100 of conductor 52 back toward body 12. The mere size of the enlarged portion of chamber 90 formed by recesses 106 and 110 would serve to fix conductor 54 in the position shown in the figures.

In operation, body 12 would be fixed to housing 14 which in return would be mechanically connected to lighting fixture 26 by the use of flare bushing 28. Leads 40 and 42 would connect to the lamp within lighting fixture 26 and extend into body 12 for connection of wires 70 and 72 to terminals 66 and 68. In turn, terminal 66 and 68 would be crimped to the first end portions 60 and 62 of conductor prongs 52 and 54 respectively. Doors 80 and 82 would then be closed to form chambers 88 and 90 respectively. Terminal 52, of course, would be free to move upwardly from the top surface of first end portion 56 of body 12. The user would then determine which circuit light fixture 26 would enter. Accordingly, first conductor prong 52 would be moved upwardly or downwardly determined by the confining ends 112 and 114 of the enlargements 104 and 108 of chamber 88. The adapter 10 would then be pushed into the lighting track and twisted in position in the conventional manner for use. The attachment to the lighting track would mechanically and electrically connect the adapter 10 to the lighting track.

While in the foregoing embodiments of the inventions have been set forth in considerable detail for the purposes of making a complete disclosure of the invention, it may be apparent to those of skill in the art that numerous changes may be made in such detail without departing from the spirit and principles of the invention.

What is claimed is:

1. An adapter for electrically and mechanically attaching a lighting fixture to a lighting track comprising:

a. a body including a first end portion and a second end portion, said second end portion being mechanically connected to the lighting fixture;

b. a first conductor positioned within said body, said body including a first recess for at least partially enclosing said first conductor, said body also including a first door having a recess for forming a chamber with said first recess of said body, said first chamber including first and second openings for permitting extension of said first conductor from said chamber, said first opening of said first chamber permitting said first conductor to electrically contact the lighting track, said first chamber being sufficiently large to permit movement of said first conductor therewithin, said first conductor being capable of extending further from said body than said second conductor, said first chamber including a stop for limiting extension of said first conductor therefrom;

c. a second conductor positioned within said body, said body including a second recess for at least partially enclosing said second conductor, said body also including a second door having a recess for forming a chamber with said second recess of said body, said second chamber including first and second openings for permitting extension of said second conductor from said chamber, said first opening of said second chamber permitting said second conductor to electrically contact the lighting track, said second chamber including means for preventing movement of said second conductor therewithin, and wherein said first and second doors can be opened to allow access to said first and second conductors.

2. The adapter of claim 1 in which said first and second doors are hingedly attached to said body.

3. The adapter of claim 1 in which said means for electrically connecting said first conductor to the lighting fixture includes said first conductor having a first end portion and a second end portion, and further includes means for mating said first and second end portions of said first conductor within said first chamber.

* * * * *